US011095983B1

(12) United States Patent
Coombs

(10) Patent No.: US 11,095,983 B1
(45) Date of Patent: Aug. 17, 2021

(54) SPEAKER ARRAY SYSTEM WITH WI-FI AMPLIFIER

(71) Applicant: Jeffery J Coombs, Lake Havasu City, AZ (US)

(72) Inventor: Jeffery J Coombs, Lake Havasu City, AZ (US)

( * ) Notice: Subject to any disclaimer, the term of this patent is extended or adjusted under 35 U.S.C. 154(b) by 0 days.

(21) Appl. No.: 16/515,581

(22) Filed: Jul. 18, 2019

Related U.S. Application Data

(63) Continuation-in-part of application No. 15/393,592, filed on Dec. 29, 2016, now Pat. No. 10,638,228, which is a continuation-in-part of application No. 15/199,874, filed on Jun. 30, 2016, now Pat. No. 10,051,369, and a continuation-in-part of application No. 13/625,297, filed on Sep. 24, 2012, now abandoned, and a continuation-in-part of application No. 12/806,596, filed on Aug. 17, 2010, now abandoned.

(60) Provisional application No. 62/700,201, filed on Jul. 18, 2018, provisional application No. 62/272,387, filed on Dec. 29, 2015, provisional application No. 61/541,070, filed on Sep. 29, 2011, provisional application No. 61/343,088, filed on Apr. 22, 2010, provisional application No. 61/274,618, filed on Aug. 18, 2009.

(51) Int. Cl.

| | |
|---|---|
| ***H04R 3/12*** | (2006.01) |
| ***H04R 1/26*** | (2006.01) |
| ***H04R 5/02*** | (2006.01) |

(52) U.S. Cl.
CPC ..... *H04R 3/12* (2013.01); *H04R 1/26* (2013.01); *H04R 5/02* (2013.01); *H04R 2420/07* (2013.01)

(58) Field of Classification Search
CPC ..... H04R 1/2811
See application file for complete search history.

(56) References Cited

U.S. PATENT DOCUMENTS

| | | | | |
|---|---|---|---|---|
| 4,953,218 A * | 8/1990 | Hughes, Jr. | H04R 27/00 | 381/55 |
| 5,532,649 A * | 7/1996 | Sahyoun | H03F 1/52 | 330/297 |
| 8,873,788 B1 * | 10/2014 | Coombs | H04R 1/2811 | 381/338 |
| 10,638,228 B1 * | 4/2020 | Coombs | H04R 3/12 | |
| 2006/0269093 A1 * | 11/2006 | Coombs | H04R 1/2849 | 381/386 |
| 2007/0104336 A1 * | 5/2007 | Knight | H04R 3/14 | 381/99 |
| 2007/0189554 A1 * | 8/2007 | Innis | H04R 3/12 | 381/111 |

(Continued)

*Primary Examiner* — Fan S Tsang
*Assistant Examiner* — Angelica M McKinney
(74) *Attorney, Agent, or Firm* — Paul B. Heynssens Attorrney at Law, PLC

(57) ABSTRACT

A multiple speaker outdoor audio system receiving wi fi signals. The array comprises multiple range 30 to 40 ohm speakers connected in parallel to a wi fi enabled amplifier. The number of speakers are selected to maintain the load on the system amplifier within an acceptable range, usually 1 to 8 ohms. The array may also include a low range speaker such as an 8 ohm sub-woofer. The speaker array "kit" may be used indoors or outdoors and allows the user to distribute an array of speakers and sub woofer over an area to achieve balanced coverage using Wi Fi amplifier.

14 Claims, 11 Drawing Sheets

(56) References Cited

U.S. PATENT DOCUMENTS

| | | | | |
|---|---|---|---|---|
| 2011/0317861 | A1* | 12/2011 | Haase | F21S 8/026<br>381/333 |
| 2012/0087529 | A1* | 4/2012 | Coombs | H04R 1/345<br>381/334 |
| 2016/0316296 | A1* | 10/2016 | Coombs | H04R 1/403 |
| 2018/0041829 | A1* | 2/2018 | Combest | H04R 5/02 |

* cited by examiner

(12) twelve speakers wired in parallel into a standard 4 to 8 Ohm stereo audio amplifier.
(5) Five full range loudspeakers and (1) one subwoofer per amplifier channel in any order.
Load is 4 Ohm per channel.
Daisy chain wiring along a (2) two conductor cable wire.

Alternative Example of an In-Ground Audio Sub Woofer with a Rectangular Prism-Shaped Housing
601

1100

SPEAKER ARRAY SYSTEM WITH WI-FI AMPLIFIER

CROSS-REFERENCE TO RELATED APPLICATIONS

This application is a continuation-in-part of application Ser. No. 15/393,592, filed Dec. 29, 2016, which also claims the benefit of U.S. Provisional Patent Application No. 62/700,201, filed Jul. 18, 2018, the contents of which are hereby incorporated by reference. Application Ser. No. 15/393,592 also claims the benefit of U.S. Provisional Patent Application No. 62/272,387, filed Dec. 29, 2015, the contents of which are hereby incorporated by reference. Application Ser. No. 15/393,592 is also a continuation-in-part of application Ser. No. 15/199,874, filed Jun. 30, 2016 which is a continuation-in-part of application Ser. No. 12/806,596, filed Aug. 17, 2010 which also claims the benefit of U.S. Provisional Patent Application No. 61/274,618, filed Aug. 18, 2009, and U.S. Provisional Patent Application Ser. 61/343,088, filed Apr. 22, 2010, the contents of which are hereby incorporated by reference. Application Ser. No. 15/393,592 is also a continuation-in-part of application Ser. No. 13/625,297, filed Sep. 24, 2012 which also claims the benefit of U.S. Provisional Patent Application No. 61/541,070, filed Sep. 29, 2011, the contents of which are hereby incorporated by reference.

TECHNICAL FIELD

The present invention relates to multi-speaker sound system and more particularly relates to a sound system in which an array of speakers are wired in parallel and connected to an audio source.

BACKGROUND

Typically audio systems, such as stereo systems, utilize a two-channel system. The two-channel system basically mixes multiple instruments, voices, effects and other audible signals into two signals or channels. Two-channel amplifiers drive loud speakers to reproduce these signals in audible form. Often a user wishes to power additional pairs of speakers from an amplifier.

Some of the newer systems do provide the option of additional zones so that a second pair of speakers can be used in locations such as a bedroom or office. The amplifiers are designed to not impose any additional load impedance.

The audiophile who wishes power a number of speakers may have to utilize a distribution amplifier and control system utilizing multiple amplifier channels. Such systems can both be technically complex and expensive.

Speakers may be wired in series or in parallel. Series wiring is relatively simple. When speakers are connected in this manner, the load impedance increases, as speakers are added the higher the impedance, as well as the higher impedance of the speaker reduces current draw from the amplifier. A common reason for raising the impedance is to lower acoustical output. Speaker output declines because the amplifier's power output decreases as load impedance increases. While it is possible to connect a number of speakers in series, it is suggested that the total equivalent load impedance for each channel be maintained between a safe level such as 16 ohms as most amplifiers are not designed to handle higher loads. Series wiring results in undesirable current hogging (uneven distribution of power) between series wired speakers.

In series installations, the amplifier sends an audio signal out through the positive speaker terminal into the first speaker. The signal is then sent from the first speaker to subsequent speakers until the circuit is completed. The negative terminal allows speakers to be connected to the amplifier's negative connection.

As mentioned above, in some cases a user wishes to power multiple speakers and will connect the speakers in parallel. However, with conventional parallel speaker wiring, the load impedance drops when speakers are wired in this fashion. The more speakers that are included in the system lower the impedance. The number of speakers that can be connected in parallel wiring is limited by the minimum load impedance that the amplifier is capable of driving and the power handling capacity of the speakers. In most installations, load impedance should be held to a minimum 4-8 ohms provided the amplifier can handle impedance that low.

By way of example, the load impedance for a parallel wired system can be calculated by the following equation:

$$zt=(za*zb)/(za+zb)$$

where: zt=load impedance za, zb represents the impedance of the speakers a, b

Using this equation, the impedance of each of the speakers are multiplied and the result is divided by the sum of the speaker's impedance.

Completing this equation, based on using two speakers having 8 ohms power rating it will be seen that the equation, when solved for zt, the net or equivalent load impedance for each channel is 4 ohms. Most standard amplifiers are rated in the 1 to 8 ohms range and therefore the minimum load impedance of most amplifiers is exceeded.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The present example provides a system to which an array of multiple speakers (typically 10 full range speakers, and 2 subwoofers) may be wired in parallel to a standard 4-8 ohm stereo audio amplifier that is wi fi enabled without imposing an excessive load on the amplifier. A complete system includes 10 full range loud speakers, and 2 sub-woofers. The speakers may be wired in parallel and connected to the amplifier so that the user can position the speakers at selected locations either indoors or outdoors.

The system has particular application to outdoor speaker systems where a user wishes to place or position speakers around a yard or patio area for maximum coverage and enjoyment.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

Figure 1:
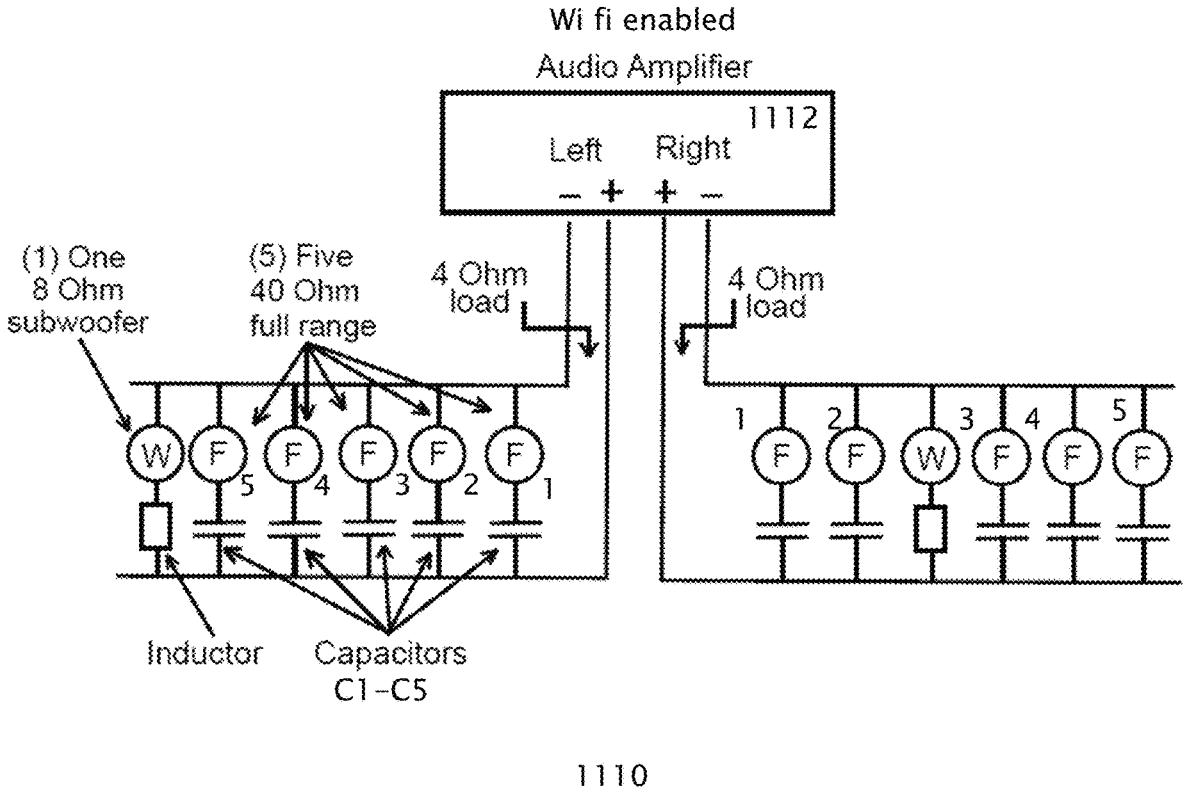
FIG. 1 shows a diagram of the speaker system of the present invention

FIG. 1 is a diagram of the speaker system of the present invention. The system which is generally designated by the numeral 1110, has a 4 to 8 ohm audio amplifier that includes a wireless reception device such as a wi fi device 1112 that allows for the reception of wireless audio signals. In alternative examples the wi fi device may provide bi-directional communications. The audio amplifier 12 has left and right channels, each connected to an array of five full range 40 ohm speakers F1, F2, etc. There are five speakers shown in each channel designated F1 to F5. Each is connected in parallel between the positive and negative conductors shown connected to the amplifier 1112.

Amplifiers in general magnify an input to produce an output signal of greater value by converting DC power. Here audio Amplifier 1112 includes a standard voltage amplifier, which is the type of amplifier often found in audio applications. In general most engineers when referring to an amplifier are typically referring to one in which voltage is amplified. The amplification of voltage is typically assumed, since a voltage is an easily measured quantity (typically more so than the measurement of current or power). An audio amplifier typically amplifies small voltages into higher voltages. Its gain is typically expressed in terms of the ratio of output to input voltage as Voltage Gain (Av)=20*Log (Vout/Vin). In a voltage amplifier the current output may be greater, equal to, or less than the input current, since the gain is only defined in terms of the ration of input to output voltages.

For example a turn table may output a voltage in the millivolt range, which is susceptible to background noise interference, and unsuitable for driving speakers. Such a signal typically requires one or more stages of pre-amplification and/or amplification providing voltage gain in order to operate a subsequent amplifier or the speakers. For the speakers a sufficient voltage must be applied across a speaker's terminals, and the impedance they present, to cause the speaker to produce sound. If such a small voltage in the millivolt range would be applied across a typical speaker's terminals, no sound would be produced, hence amplification of the voltage level is needed, and a voltage amplifier provides that needed amplification in audio circuits. With respect to the amplifier's current output, it typically needs to source current sufficient to maintain a drive current to prevent clipping of the amplified signal as applied to a complex impedance that can vary depending upon speaker utilized (typically either 4 Ohms, or 8 Ohms, nominally). In audio amplifiers current is typically not the signal being amplified, voltage is being amplified to provide a signal of sufficient amplitude to induce a current across the terminal impedance of the speaker.

Amplifiers as described herein are typically cascaded, and an individual amplifier module may include multiple stages such as impedance buffers, filters, a plurality of gain stages, and various types of amplifiers in order to achieve an overall system design, or port characteristics.

Amplifiers in audio, and general purpose applications are generally voltage amplifiers for the reasons stated above. However, other types of specialized amplifiers may be encountered from time to time in electronics. For example, in radio frequency and microwave engineering amplifiers are often encountered. Here, the typical type of amplifier is a power amplifier. These amplifies typically amplify power as measured in Watts, which is different from conventional amplifiers used at baseband frequencies. Their gain is expressed as a ration of output to input power stated as: Power Gain (Av)=10*Log (Pout/Pin). Power amplifiers may be encountered in audio applications—but are usually referred to as such. In addition the power output of audio power amplifiers tend to be rated differently than RF power amplifiers. The power rating of an RF power amplifier refers to the output power-excluding conversion losses in the amplifier. An audio power amplifier power rating tends to be the total power consumed from the DC sources including conversion losses plus output power. In audio applications a power amplifier may produce both increased current and voltage.

In certain typically very specialized applications "current amplifiers" may be applied. In such usage the output typically encounters an extremely low impedance, typically when trying to drive a signal down a long cable, or the like. Another application is in robotics where a current amplifier may be used to drive a motor to achieve movement of the robot.

Sometimes, an amplifier may be needed to produce an output current proportional to the input voltage such an amplifier circuit is called a trans-conductance amplifier. When an output voltage proportional to an input current is called for an amplifier circuit called a trans-resistance amplifier is utilized. In the examples provided herein a conventional voltage gain amplifier is utilized, operating in the typical baseband audio range of substantially 20 Hz to 20 kHz.

Amplifier gain may affect the loudspeaker load. It is typically important that adequate voltage output drive from the preamplifier to the audio amplifiers 12 voltage input allows the power amplifier to reach full power. The amplifier may need a specific current stage, or source, to deal with the loudspeakers complex load impedance. If sufficient current into the load is not available then the output voltage waveform may exhibit voltage sag/clipping on the amplifier side. Ideally of course, an amplifier would act as a voltage source or pure voltage amplifier, maintaining output regardless of the load (i.e. it would "double down" into 4 ohms, and "double down" again into 2 ohms).

For systems having 3-30 ohm speakers, the load is calculated at 5 ohms, again with the capability of a standard 1 to 8 ohm receiver. For systems with larger expansion capabilities, higher speaker impedances such as 40 ohms would be used. For systems intended for more limited applications and fewer speakers, 20 or 30 ohm speakers F1, F2, etc., may be used.

In addition, each of the left and right channels contains a woofer W which is an 8 ohms sub-woofer. Inductor I and capacitors C1 to C5 are incorporated into the speakers. The inductor I is selected to maintain the output of the sub-woofer below a level such as 80 Hertz. The capacitors C1 to C5 are selected to maintain the output of the full range speakers above a selected level such as above 80 Hertz.

When the impedance $z_t$ of this system is calculated, the solution for a system having 5-40 ohm speakers is as follows:

$$1/z_t=1/40+1/40+1/40+1/40+1/40+5/40$$

$$1/z_t=10/40$$

$$z_t=4$$

The result is that the amplifier load on each channel is 4 ohms which is within the capability of a standard stereo receiver which are rated between 1 to 8 ohms. Thus, using five 40 ohms full range speakers, as shown, along with one 8 ohms sub-woofer, a standard amplifier can safely handle the load.

While the present invention has been described with reference to multi-channel systems, an array of five 40 ohm voice coil speakers arranged in parallel, with or without a sub-woofer, can be connected to a monoral amplifier.

With the present invention, a dual voice coil 8 ohm woofer may be connected to both channels operating as a woofer for each channel so that both left and right channel bass is reproduced.

The system of the present invention allows the connection of multiple speakers to many standard amplifiers providing wide coverage with even sound distribution. A user can connect multiple full range speakers and a sub-woofer in parallel to an existing amplifier spaced about an interior living area substantially increasing the coverage.

The audio system of the invention utilizes a dual voice coil sub-woofer rated at 8 ohms. The dual voice coil sub woofer has two coils each with a negative and a positive connection. The description of an exemplary subwoofer that may be used in the speaker array system follows.

Sub woofers are loud speakers for the reproduction of low frequencies generally in the range of 20 to 200 Hz and may be used in movie sound systems, car audio systems and for home audio systems including outdoor or landscaping systems. In outdoor uses the sub woofer may be buried in-ground to hide or conceal much of the enclosure.

Figure 2:
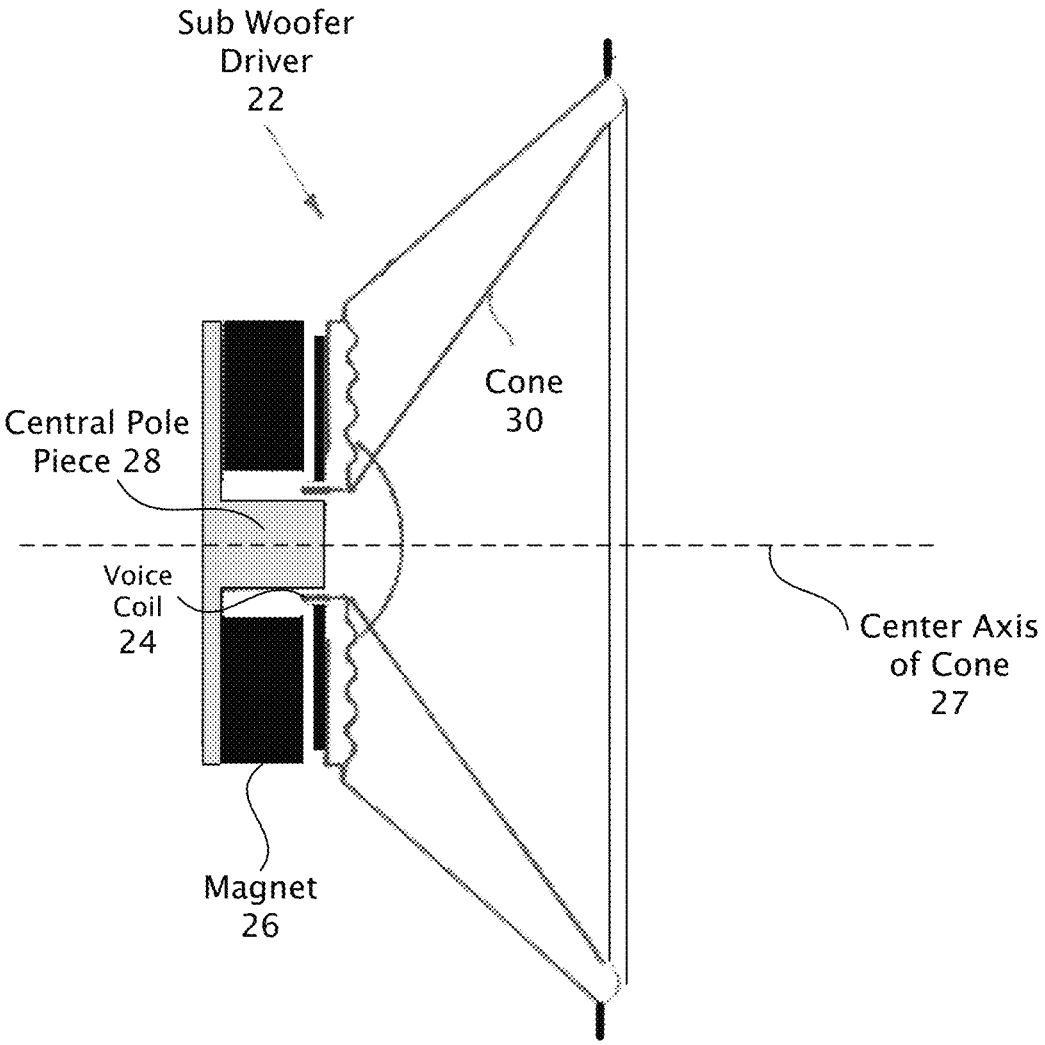
FIG. 2 is a diagram showing a sub woofer driver component as it would be disposed in the examples of an outdoor speaker enclosure described herein.

FIG. 2 is a cross section diagram showing a sub woofer driver component as it would be disposed in the examples of an outdoor speaker enclosure described herein. The driver 22 has a voice coil 24, a magnet 26 disposed around a central pole piece 28 and a diverging diaphragm or cone 30. The sub woofer components may be conventionally constructed. For mechanical support a driver, or speaker basket (not shown) would typically surround the cone 30. Typically the basket also provides points of attachment to couple the driver to a housing or other enclosure. The center axis of the cone 27 is shown horizontal as the driver would be mounted in the examples provided herein, which may be referred to as horizontal mounting. However, in conventional outdoor speaker assemblies the axis of the cone of such a driver would typically be oriented ninety degrees from that shown, or substantially vertical with respect to grade, which may be referred to as vertical mounting.

Sub woofers for in-ground installation are typically vertically mounted, that is, with the axis of the driver cone vertical and, as such, the driver is subject to the effects of gravity over time causing displacement of the voice coil resulting in the voice coil interference producing a loud, popping sound. Also, conventional vertically mounted in-ground speakers often encounter installation constraints which affect the depth of burial presenting possible interference with existing in-ground structures, such as sprinkler lines, electrical wires and the like. Accordingly it would be desirable to provide an in ground audio sub-woofer enclosure that facilitates substantially horizontal driver positioning.

Figure 3:
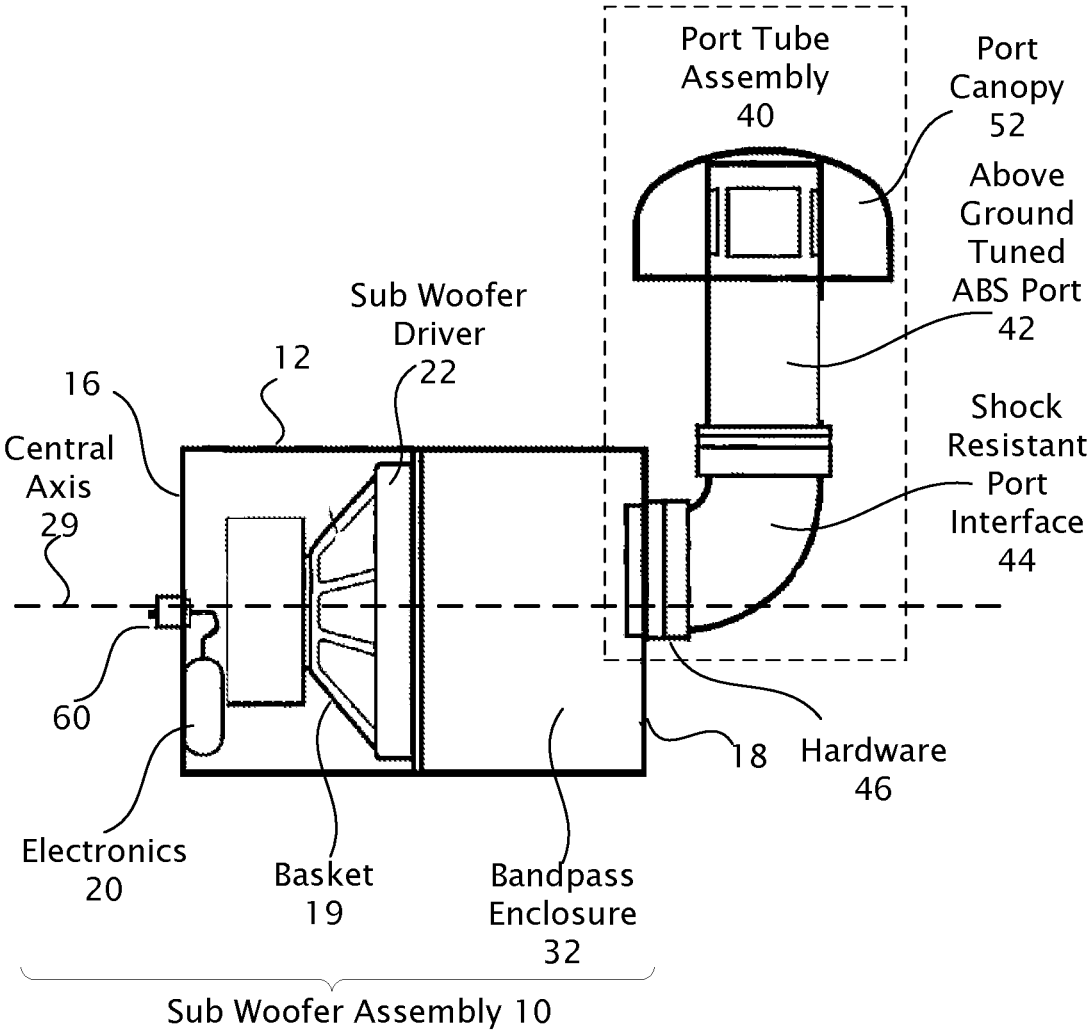
FIG. 3 is a cross-sectional view of the sub woofer of the present example.

FIG. 3 is a cross-sectional view of the in ground audio sub woofer assembly 200 of the present example. In general the in ground audio sub woofer 200 includes a woofer sub assembly 10, and a port tube assembly 40. The woofer subassembly 10 generally includes the housing 12, end caps 16 and 18, a sub woofer driver 22, a speaker basket 19, electronics 20, and connecting wires using appropriate silicone filled wire connector 60.

An enclosure or housing 12 is generally cylindrical having opposite end walls 16 and 18 capping the cylinder at opposite ends. However, other shaped enclosures (including square, rectangular, hexagonal or the like) may equivalently be provided for the cylinder, typically to accommodate various shaped drivers 22, equivalently termed a woofer, woofer speaker or driver. Although a cylindrical driver may still be made to fit such housings of various shapes or cross sections The housing 12 and end walls 16 and 18 may be fabricated from a suitable material for in-ground application such as PVC, polypropylene, fiberglass or the like. The end walls 16, 18 may be sealed to the housing 12 by suitable methods to prevent the intrusion of dirt, moisture, or other contaminants. Sealing may be by any suitable method including the addition of adhesives or other sealants if desired. Alternatively, one of the end walls may be formed as part of the housing 12.

Conventional in-ground sub woofers in use in the past may have enclosures of aluminum that may decompose underground quickly, particularly in the presence of high salinity. As the enclosures corrode and lose strength, they can collapse under any sufficiently high applied weight, creating a safety problem. The present examples utilize plastic material as opposed to metals such as aluminum, which are subject to erosion and consequently subject to collapsing. Accordingly it is desirable to form an enclosure from a material that tends not to degrade in this kind of environment, and that protects the electronics 20, and sub woofer driver 22 inside the housing 12 which is part of the subwoofer assembly 10.

The sub woofer driver 22 may be of various sizes. For most residential applications a 10" driver may be appropriate. As such, the housing 12 will typically have an axial length of about 16" to enclose a 10" sub woofer driver. The driver basket 19 is typically round. However, in equivalent alternative examples the basket 19 shape may equivalently be oval or other exemplary shapes. The shape of the driver basket, may be oval or some other shape differing from that of the housing 12, and its mounting may be facilitated by adding an adapter piece (not shown) to provide mounting between the differing shape of the housing and the driver.

However, in any such instillation the center axis of the driver 22 and its cone (27 of FIG. 1) will remain substantially coaxial, or parallel to the housing axis 29. Although not desirable the driver may also be mounted vertically, or at intermediate angles between horizontal and vertical in the housing. The driver may also be mounted horizontally with its axis parallel, but off center from the axis of the housing.

Existing low frequency drivers in in-ground speakers are typically mounted vertically and the driver components are subject to displacement induced by gravity. Such sagging may misalign the driver 22 voice coil (24 of FIG. 1) typically cause the voice coil to produce loud popping sounds, as previously mentioned. With the present invention, the internal low frequency driver is mounted horizontally eliminating the potential problem of sagging and the resultant undesirable audible effects.

The description and dimensions herein are based on an exemplary 10" driver 22 size. But it will be appreciated the present invention is applicable to other speaker sizes as the dimensions provided are exemplary.

Within the housing 12 may be located electronics 20, usually coupled to an audio source such as a remote amplifier, cross over network, or the like, typically remotely disposed from the in-ground audio sub-woofer. The electronics may provide industry standard terminal impedances such as 4 ohm, 8 ohm or the like.

In a speaker system an enclosure typically provides a structure typically ported, or otherwise constructed to allow moving air to circulate so that the sound may be effectively transmitted. In this example, a front firing band pass enclosure 32 is provided in the area of the housing between the driver 22 and the end wall 18. However, in alternative examples of in-ground audio sub-woofer enclosures other equivalent porting structures may be provided.

The port tube assembly may include a canopy 52, coupled to an above ground tuned port (or straight pipe) 42, which is coupled to a shock resistant port interface (flexible elbow pipe) 44, and a hardware coupling 46, which rotably fastens the port tube assembly 40 to the subwoofer assembly 10. Sound is transmitted to an outdoor listener from the driver 22 via enclosure 32 through a port tube assembly 40 which has a tuned port 42 formed from a section of pipe such as 4" diameter PVC pipe, or the like for the exemplary 10" speaker. The port 42 has a fixed length and is coupled to a resilient elbow 44 which serves as a shock resistant interface which tends to prevent breakage of the junction between the woofer subassembly 10 and the port tube assembly 40, should something hit the port tube assembly 40. Resilient elbow 44 is constructed from rubber, or other suitable materials to absorb shock and seal the assembly. The above ground tuned port 42, the resilient elbow 44 and the port canopy 52 are included in the port tube assembly 40. The opposite end of the elbow 42 terminates at a stainless steel fitting 46 at end wall 18, where a matching aperture (not shown) is disposed in the end wall 18. The fitting, or hardware, 46 is a coupling which allows relative rotation between the housing 12 and port tube assembly 40 at installation as will be more fully described below. Typically the hardware 46 is loosened so that the port tube assembly can be positioned to protrude from the ground by a desired height. Since the port tube assembly is off center from central axis 29, rotating the subwoofer assembly tends to raise or lower the canopy 52 relative to the surface of the ground in which the subwoofer assembly is disposed. The tube 40 is provided with apertures 50 at its upper end to allow sound to escape. A semi-spherical, or equivalent, canopy 52 extends over the upper end of the port and protects against infiltration of moisture, dirt and debris. The canopy is preferably a copper or other material which will weather to an attractive, aesthetically pleasing patina. However, any suitable material may be utilized for the canopy 52. The distance above ground of the tuned port should equal the diameter of the tuned port, in this case 4", in order to obtain the desired increase of 3 decibels in sound level.

Figure 4:
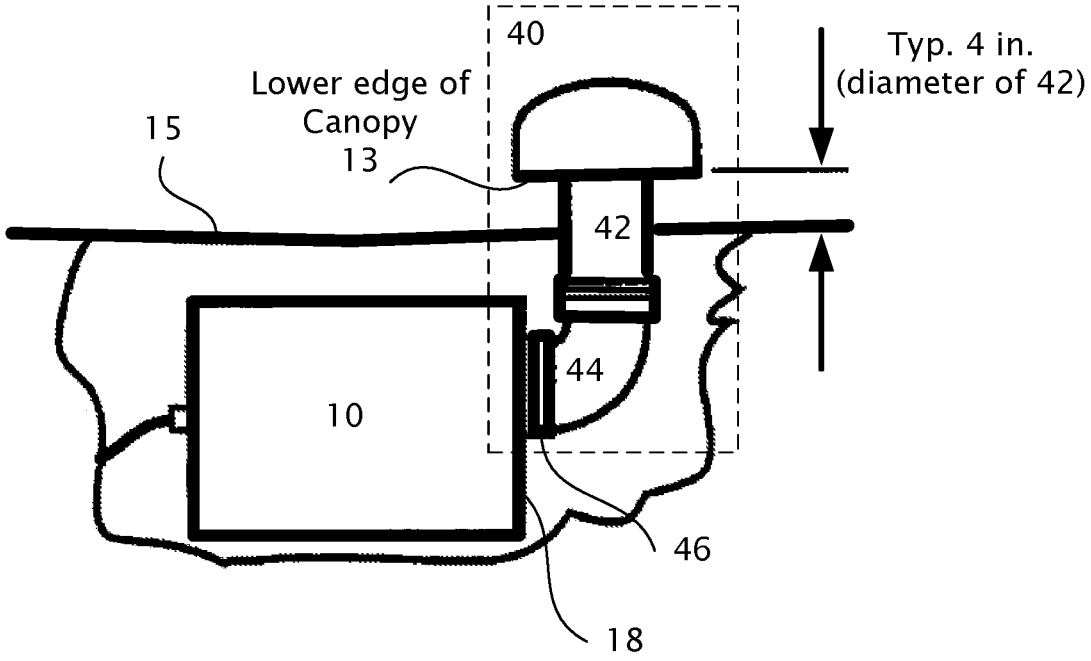
FIG. 4 is a side view showing the in-ground installation of the sub woofer according to the present invention.

FIG. 4 is a side view showing the in-ground installation of the audio sub woofer according to the present invention. The woofer sub assembly 10 may be installed in a suitable outdoor location depending on the area, shape and landscaping of the area, or the like. Installation is begun by excavating in an area that should not be subject to flooding. The excavation should be approximately 16" wide×26" long and have a depth of between 13"-16" to accommodate a 10" audio sub woofer dimensioned as described above and should be prepared free of voids and rocks. The woofer subassembly 10 is placed in the excavation in a horizontal position, as shown in FIGS. 3 and 4. The housing is positioned so that the elevation of the lower edge 13 of the port tube assembly 40 is 4" above finished grade 15. The port tube assembly 40 including the port tube 42 and resilient port interface 44 are then attached to the coupling 46 at housing end wall 18 in a selected position.

Figure 5:
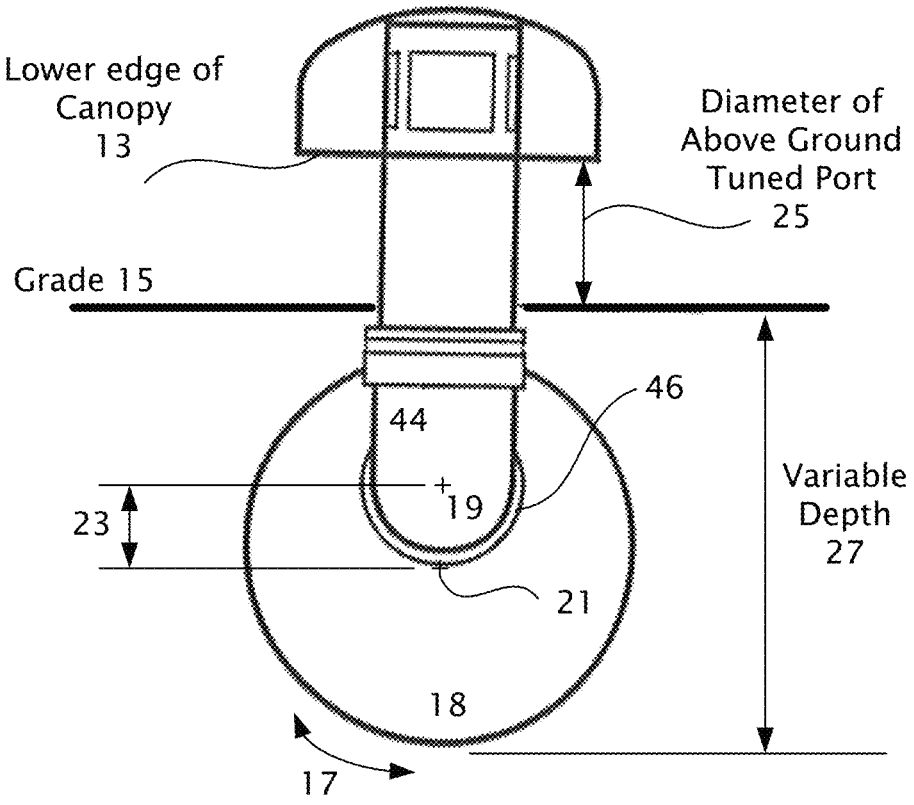
FIG. 5 is a front view of the installation of FIG. 3.

FIG. 5 is a front view of the installation of FIG. 3. As previously mentioned to maintain a 3 dB gain it is desirable to maintain a distance 25 equal to the diameter of the above ground tuned port 42 between the grade 15 and the edge of the port canopy 13. In installations in which a hole can not be dug deep enough to provide the desired distance 25 adjustment is provided for in the design of the sub woofer assembly 12. In particular the port interface is not coupled to the end cap 18 at its center 21. The center of the tubular port interface 19 is offset 23 from the center 21 of the end cap 18. The shock resistant tubular port interface 44 is rotabaly coupled 17 to the cap 18 so that holes of variable depth 27 may be compensated for in installation to maintain the desired distance 25 after installation. Aside from clearing obstructions the adjustment mechanism also makes it easier to install the subwoofer speaker system and adjust to the desired distance 25 without having to deepen the hole, or add material to the hole to raise the assembly.

Rotabaly coupling of the port interface 44 to the cap 18 is achieved with hardware 46 that is constructed utilizing techniques known to those skilled in the art to provide free rotation during assembly and suitably maintain a seal of the assembly 12 to prevent the intrusion of moisture and other contaminants. Alternatively, the hardware 46 may be eliminated with the coupling mechanism integrally constructed into the port interface 44, the cap 18, or both 18, 44.

Figure 6:
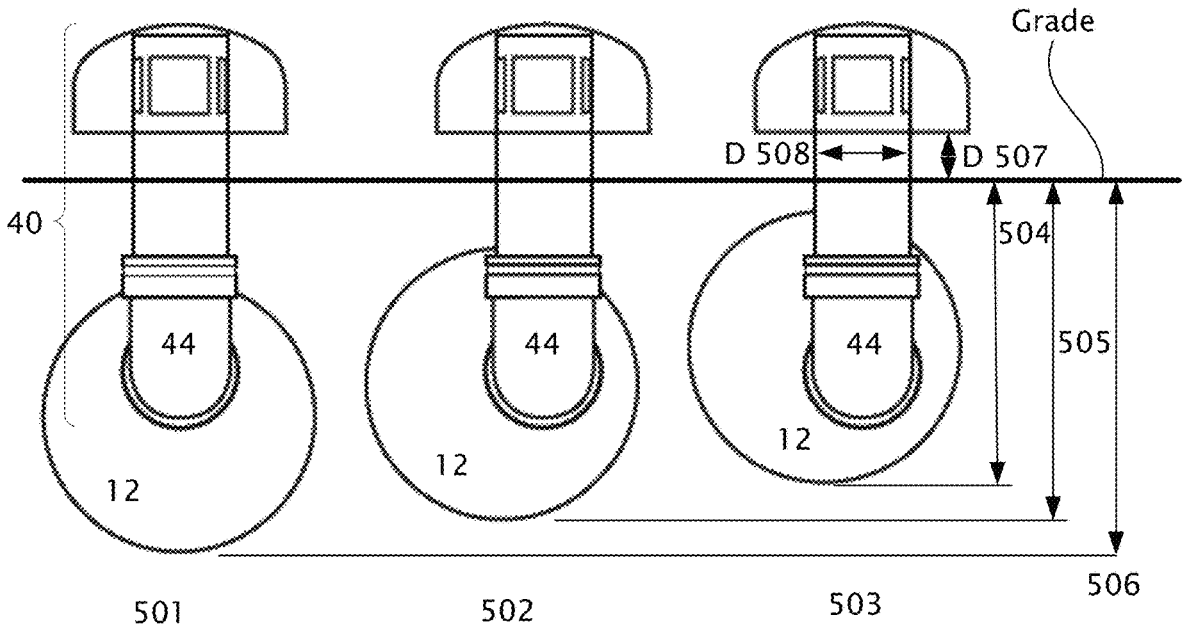
FIG. 6 is a front view illustrating several installation options available with the present invention.

FIG. 6 illustrates various positions 501, 502, 503 of the eccentrically coupled port tube assembly 40, and it port interface 44 relative to the housing 12 to accommodate variable depth installation 504, 505, 506. As mentioned, the burial depth may be subject to limitation by existing in-ground obstacles or other considerations. If no obstacles exist, full depth installation for a 10" woofer typically requires the excavation to be 16" below grade. If the housing cannot be installed in a full depth excavation, the burial depth 504, 505, 506 can be varied, still maintaining the proper above ground spacing 507 (typically equal to the tuned port diameter 508) for the port tube assembly 40.

The installation is completed by connecting wires (60 of FIG. 3) using appropriate silicone filled wire connectors or their equivalent and appropriate junction boxes or their equivalent maintaining the proper polarity of the speaker wires. The resulting installation results in an in-ground sub woofer for omni-directional reproduction of outdoor sound. The sub woofer (200 of FIG. 3) is intended for use in a system with other full range speakers to produce a full range of frequencies. The listening area for a 10" woofer installed as described above will be about 2000 sq. ft.

As previously mentioned housings having different shapes may be utilized in constructing an in-ground audio sub woofer. The following paragraphs describe one such alternative example.

Figure 7:
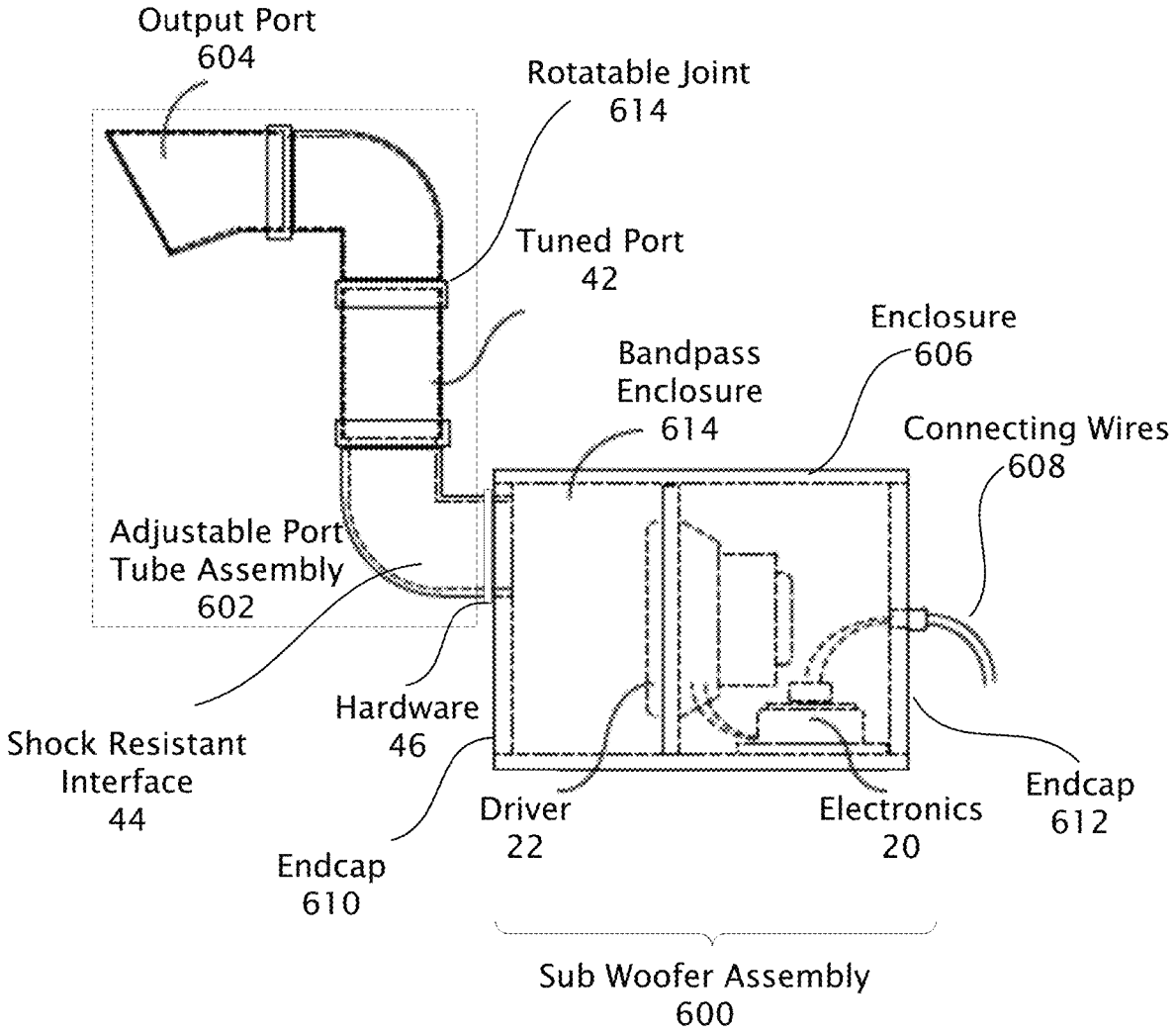
FIG. 7 is a cross-sectional view of the sub woofer of an alternative example of an in ground audio sub-woofer with a rectangular prism-shaped housing.

FIG. 7 is a cross-sectional view of an alternative example of an in-ground audio sub woofer with a rectangular prism-shaped housing 601. Unless otherwise indicated the various features of the alternative example may be considered to be as previously described for corresponding components between the examples. The sub woofer assembly 600 has a generally rectangular enclosure or housing 606 having opposite end walls 610 and 612. However, other shaped enclosures, including cubic enclosures, may equivalently be provided, typically to accommodate various shaped drivers 22.

The housing 606 and end walls 610 and 612 may be fabricated from a suitable material for in-ground application such as PVC, polypropylene, fiberglass or the like, as described previously. The end walls 610 and 612 may be sealed to the housing 606 by suitable methods to prevent the intrusion of dirt, moisture, or other contaminants. Sealing may be by any suitable method including the addition of adhesives or other sealants if desired.

The sub woofer driver 22 may be of various sizes as described previously. The sub woofer driver 22 may be mounted horizontally to eliminate the potential problem of sagging and the resultant undesirable audible effects.

Sound is transmitted from the driver 22 via the bandpass enclosure 614 through a port tube assembly 602 which has a tuned port 42 formed from a section of pipe such as 4" diameter PVC pipe for the exemplary 10" speaker. The port 42 has a fixed length and is connected to a resilient elbow 44 which serves as a shock resistant interface. The tuned port 42, the resilient elbow 44, and the output port 604 comprise the port tube assembly. In this alternative example sound tends to be directed by the addition of the rotable joint 614, and the shape of output port 604. In the previous example the porting was more of an omni directional configuration. The coupling of the output port 604 to the rotable joint 614 is a substantially right angle coupling. The opposite end of the elbow 44 terminates at a stainless steel fitting for rotatably coupling to the enclosure end 610. The fitting is a coupling which allows relative rotation between the housing 606 and port tube assembly 602. The port tube assembly 602 is provided with an outlet port 604 at its termination. The outlet port 604 is attached to the tuned port 42 with a rotatable joint 614. The outlet port 604 may be positioned to direct audio output in any desired direction. The outlet port 604 is preferably a copper or other material which will weather to an attractive, aesthetically pleasing patina. However any suitable material may be utilized. A uni-directional output port may be desirable in areas where neighbors or others may be in close proximity.

Figure 8:
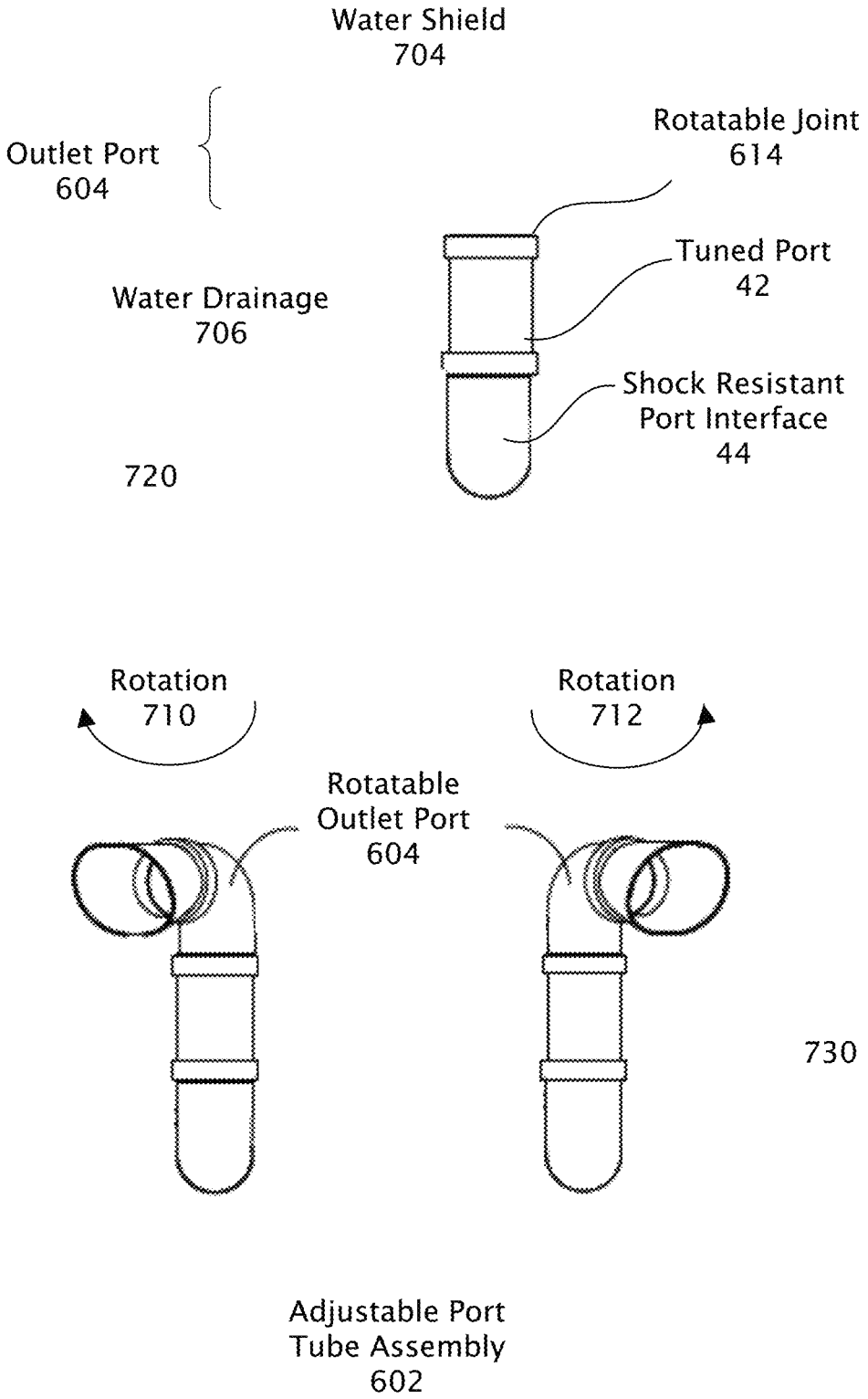
FIG. 8 is multiple views of the rotatable uni-directional output port.

FIG. 8 is multiple views of the rotatable uni-directional output port of the adjustable port tube assembly 602. A side view of the rotatable adjustable uni-directional port tube assembly 602 is shown at 720. The outlet port 604 may be provided with a water shield 704 to inhibit infiltration of rain, snow, or water from sprinklers into the sub woofer assembly 600 (not shown). Additionally, the lower edge of the outlet port 604 may be provided with a downward slope to allow water drainage. The outlet port 604 may be coupled to the tuned port 42 via a rotatable joint 614, which allows the outlet port 604 to be pointed in various directions desired by the user. The rotatable outlet port 604 can be rotated in exemplary directions 710 and 712.

Figure 9:
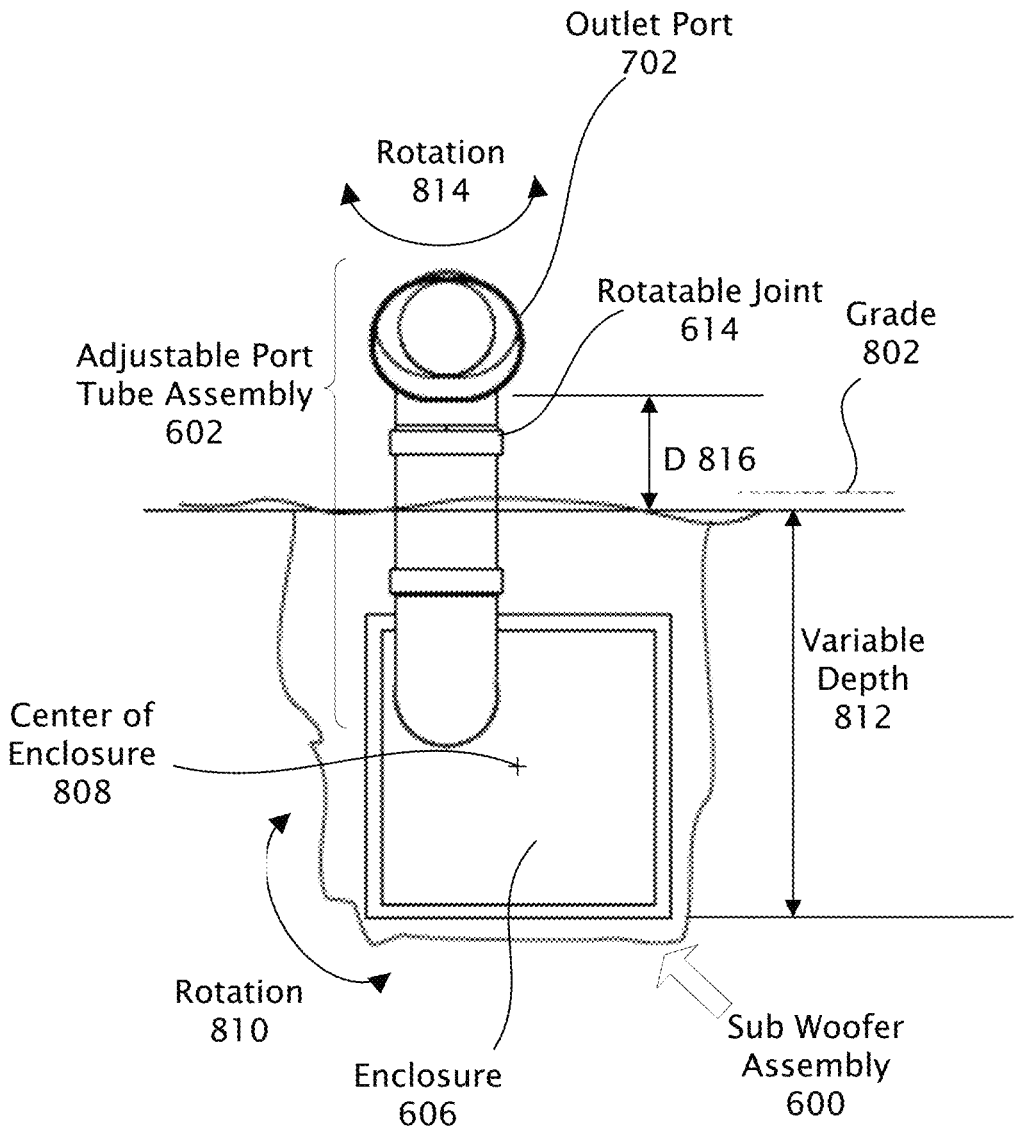
FIG. 9 is a front view of the in-ground audio subwoofer system shown in FIG. 7.

FIG. 9 is a front view of the in-ground audio subwoofer system shown in FIG. 7. This example also includes an adjustable port tube assembly 602, rotabaly coupled to a sub-woofer assembly 600. As previously mentioned to maintain a 3 dB gain it is desirable and typically obtained by maintaining a distance 816 equal to the diameter of the above ground tuned port between the grade 802 and the bottom edge of the outlet port 804. In installations in which an excavation cannot be created sufficiently deep to provide the desired distance 816 between grade 802 and the lower edge of the port tube assembly 804, adjustment is provided for in the design of the sub woofer assembly 600. The shock resistant port interface 44 is not coupled to the end of the enclosure 610 at its center 808. The tubular port interface is offset from the center 808 of the end of the prism shaped enclosure 606. The shock resistant port interface 44 is rotatably coupled to an aperture (not shown) disposed in the end of the enclosure 606 so that excavations of variable depth 812 may be compensated for in installations to maintain the desired distance 816 after installation.

Coupling of the shock resistant port interface 44 to the end of the enclosure 606 is achieved in the same fashion as described above for a cylindrical in-ground audio subwoofer system. In addition the outlet port 702 may rotate 814 to direct the sound as desired.

Figure 10:
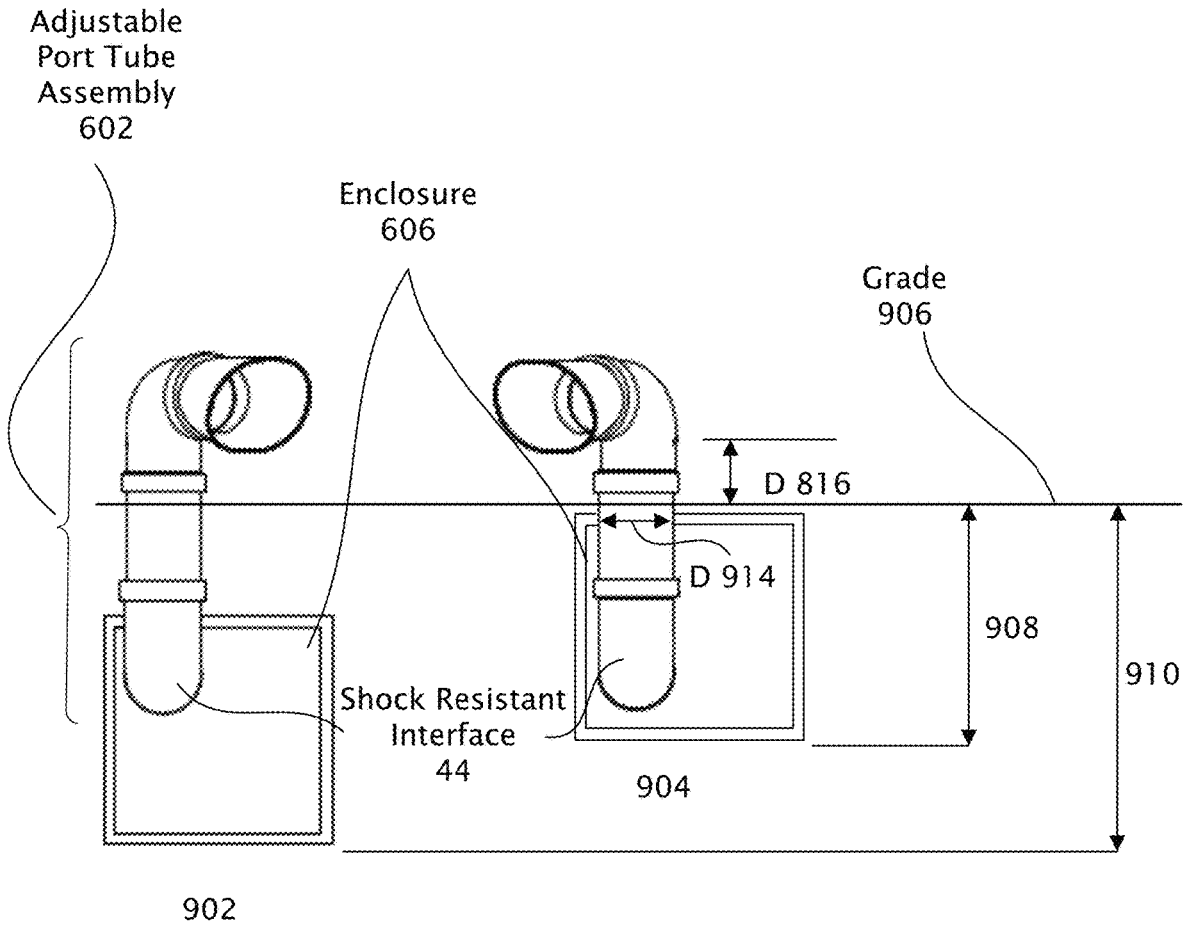
FIG. 10 is a front view illustrating several installation options of the in-ground audio subwoofer system shown in FIG. 7.

FIG. 10 is a front view illustrating installation options of the alternative in-ground audio subwoofer system 601. The figure illustrates various positions 902 and 904 of the shock resistant interface 44 relative to the enclosure housing 606 to accommodate variable depth installation 908 and 910. As mentioned, the burial depth may be subject to limitation by existing in-ground obstacles or other considerations. If no obstacles exist, full depth installation for a 10" woofer typically requires the excavation to be 16" below grade. If the housing cannot be installed in a full depth excavation, the burial depth 908 and 910 can be varied while maintaining the proper above ground spacing 816 (typically equal to the tuned port diameter 914) for the port tube assembly 602.

The resulting installation results in an in-ground sub woofer for variable uni-directional reproduction of outdoor sound. The sub woofer is typically intended for use in a system with other full range speakers to produce a full range of frequencies.

It will be obvious to those skilled in the art that the omni-directional outlet port (40 of FIG. 3) and the rotatable uni-directional outlet port 602 are interchangeable with either the cylindrical enclosure (10 of FIG. 3) or the rectangular enclosure (600 of FIG. 7), or enclosures of other equivalent shapes.

To emphasize the desirability of having an in ground audio subwoofer with the adjustable featured described above, with current underground sub woofers, the tuned port has a fixed length determined by the accurate tuning of the sub woofer frequency. The tuned port is optimally 4" above the ground to obtain a 3 decibels gain since the diameter of the tube is 4". The burial depth of conventional sub woofer speakers is constrained by lack of adjustment, often resulting in conflict with underground conduits like sprinklers, electric wires, plumbing and the like. The present examples provide a cylindrical-shaped and rectangular prism-shaped sub woofer enclosure or housing with a tuned port of proper fixed length attached to the end of the enclosures in an offset position. The port connects to the housing so that the orientation of the port remains vertical. As the housing is rotated, the offset port will extend above the outer periphery of the housing a distance approximately equal to the diameter of the housing 12 or the length of one side of the square end of the housing 606. Hence, the dimensions of the housing provides added flexibility in burial depth overcoming the aforementioned problems.

Figure 11:
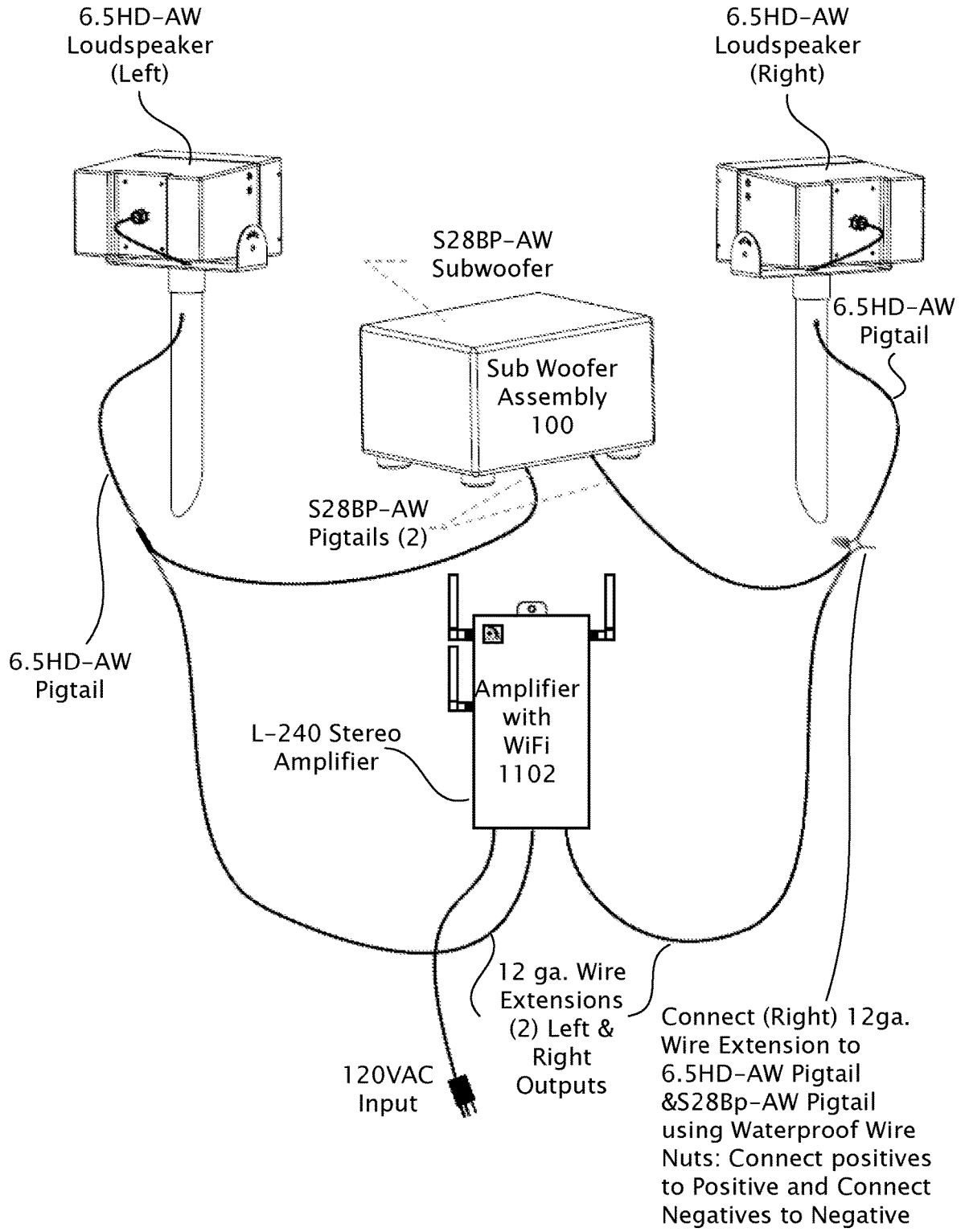
FIG. 11 shows an Outdoor Audio system Including an Weatherproof Outdoor Audio Amplifier with Wi-Fi.

FIG. 11 shows an Outdoor Audio system Including an Weatherproof Outdoor Audio Amplifier with Wi-Fi 1102.

Described herein is a weatherproof outdoor audio system 1100 that accepts music from various sources and amplifies and distributes the music to a variety of outdoor speakers utilizing unique distribution technologies that may include low voltage in ground trunk line distribution, a unique speaker array system configuration, a 15 volt amplifier, and a unique in ground audio sub woofer 100.

The weatherproof outdoor audio amplifier receives source material (Music) three different ways. Wi-Fi, Bluetooth, or via a hardwired connection. The Weatherproof Outdoor Audio Amplifier with Wi-Fi also serves as a wireless access point for Internet connections.

Engineered to deliver a quality audio experience in a variety of environmental conditions, including residential settings, bars, restaurants and hotels, the subwoofers and speakers described herein can be mixed and matched to meet just about any requirement professional integrators encounter.

It will be obvious to those skilled in the art to make various changes, alterations and modifications to the invention described herein. To the extent such changes, alterations and modifications do not depart from the spirit and scope of the appended claims, they are intended to be encompassed therein.

Those skilled in the art will realize that the process sequences described above may be equivalently performed in any order to achieve a desired result. Also, sub-processes may typically be omitted as desired without taking away from the overall functionality of the processes described above.

The invention claimed is:

1. An outdoor audio system comprising:

an audio amplifier having a selected impedance rating;

conductors coupled to the audio amplifier to distribute audio signals through an output;

a Wi-Fi reception device coupled to the audio amplifier for coupling a wireless input signal to the audio amplifier;

a plurality of full range speakers each coupled in series with a capacitor, the series coupled full range speaker and capacitor coupled in parallel to the conductors, the full range speakers each having an impedance and having a desired frequency response; and an in-ground audio subwoofer speaker including a series inductor, the series combination of the in-ground audio subwoofer speaker and the series inductor coupled in parallel with the plurality of full range speakers, whereby the in-ground audio subwoofer speaker and the plurality of full range speakers are selected to maintain a load within the impedance rating of the audio amplifier, and a desired frequency response to each speaker coupled to the audio amplifier is provided, the in-ground audio sub woofer speaker including: a generally cylindrical housing having an axis having opposite first and second end walls; a driver and electrical components for receiving and transmitting audio signals, said driver including a diaphragm coaxial with the axis of the cylindrical housing; a port tube assembly having a tuned port tube with an upper end and a resilient interface elbow adjustably attached to the first end wall at an eccentric location relative to the housing axis; and a protective canopy extending over the upper end of the port tube assembly.

2. The s outdoor audio system of claim 1 in which the in-ground audio subwoofer speaker is connected in parallel between the conductors.

3. The outdoor audio system of claim 1 wherein the amplifier has a rating of 1 to 8 ohms and the voice coil of full range speakers are each rated at approximately 20 to 40 ohms.

4. The s outdoor audio system of claim 3 wherein the in-ground audio subwoofer speaker has a rating selected from the group of 4, 8 or 16 ohms.

5. The outdoor audio system of claim 1 wherein the amplifier and speakers are provided to a consumer in a pre-wired package.

6. The outdoor audio system of claim 1 wherein the capacitor associated with each full range speaker is selected to maintain the frequency response above a predetermined frequency level.

7. The s outdoor audio system of claim 1 wherein the series inductor associated with the in-ground audio subwoofer speaker sub woofer limits the frequency response below a predetermined frequency level.

8. A system for connecting to a 1 to 8 ohm audio amplifier having a selected impedance rating comprising:

A Wi-Fi device coupled to the 1 to 8 ohm audio amplifier;

conductors coupled to the 1 to 8 ohm audio amplifier to distribute audio signals through an output;

a plurality of full range speakers each coupled in series with a capacitor, the series coupled full range speaker and capacitor coupled in parallel to the conductors, the full range speakers each having an impedance and having a desired frequency response; and an in-ground audio subwoofer speaker including a series inductor, the series combination of the in-ground audio subwoofer speaker and the series inductor and a desired frequency response to each speaker coupled to the 1 to 8 ohm audio amplifier is provided, the in-ground audio subwoofer speaker including: a generally cylindrical housing having an axis having opposite first and second end walls; a driver and electrical components for receiving and transmitting audio signals, said driver including a diaphragm coaxial with the axis of the cylindrical housing; a port tube assembly having a tuned port tube with an upper end and a resilient interface elbow adjustably attached to the first end wall at an eccentric location relative to the housing axis; and a protective canopy extending over the upper end of the port tube assembly.

9. A system comprising:

a 1 to 8 ohm audio amplifier having an integral Wi-Fi device and a selected impedance rating and having left and right channels, each channel having a positive and a negative terminal;

conductors coupled to each of the terminals to distribute audio signals through left and right output channels;

a plurality of full range speakers rated at approximately 20 to 40 ohms each coupled in series with a capacitor, and each of the series coupled capacitor and full range speakers coupled in parallel to the conductors in each channel; and at least one in-ground audio subwoofer speaker coupled in series with an inductor, and the in-ground audio subwoofer speaker and series coupled inductor coupled in parallel to the conductors wherein the in-ground audio subwoofer speaker and the plurality of full range speakers are selected to maintain an impedance load within the impedance rating of the 1 to 8 ohm audio amplifier and provide a desired frequency response, in-ground audio subwoofer speaker including: a generally cylindrical housing having an axis having opposite first and second end walls; a driver and electrical components for receiving and transmitting audio signals, said driver including a diaphragm coaxial with the axis of the cylindrical housing; a port tube assembly having a tuned port tube with an upper end and a resilient interface elbow adjustably attached to the first end wall at an eccentric location relative to the housing axis; and a protective canopy extending over the upper end of the port tube assembly.

10. The system of claim 9 wherein the in-ground audio subwoofer speaker is rated at approximately 8 ohms and each coil of a pair of coils of the in-ground audio subwoofer speaker are connected in parallel in each of said channels of the 1 to 8 ohm audio amplifier.

11. The system of claim 9 wherein the in-ground audio subwoofer speaker is rated at approximately 8 ohms and each coil of a pair of coils of the in-ground audio subwoofer speaker are connected in series in each of the channels of the 1 to 8 ohm audio amplifier.

12. The system of claim 9 wherein the in-ground audio subwoofer speaker is rated at approximately 8 ohms each coil of a pair of coils of the in-ground audio subwoofer speaker are connected in series to the 1 to 8 ohm audio amplifier.

13. The system of claim 8, wherein the in-ground audio subwoofer speaker has a dual voice coil, wherein further each of the dual voice coils is connected in parallel to the 1 to 8 ohm audio amplifier.

14. The system of claim 8 wherein the in-ground audio subwoofer speaker has a dual voice coil, wherein further each of the dual voice coils is connected in series with the 1 to 8 ohm audio amplifier.

* * * * *